US011339997B2

(12) United States Patent
Song et al.

(10) Patent No.: US 11,339,997 B2
(45) Date of Patent: May 24, 2022

(54) AIR CONDITIONING APPARATUS

(71) Applicant: LG Electronics Inc., Seoul (KR)

(72) Inventors: Chiwoo Song, Seoul (KR); Ilyoong Shin, Seoul (KR); Yongcheol Sa, Seoul (KR); Jisung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 182 days.

(21) Appl. No.: 16/775,916

(22) Filed: Jan. 29, 2020

(65) Prior Publication Data

US 2020/0370795 A1 Nov. 26, 2020

(30) Foreign Application Priority Data

May 23, 2019 (KR) ..... 10-2019-0060842

(51) Int. Cl.
*F25B 13/00* (2006.01)
*F25B 41/40* (2021.01)

(52) U.S. Cl.
CPC ..... *F25B 13/00* (2013.01); *F25B 41/40* (2021.01); *F25B 2313/003* (2013.01); *F25B 2313/029* (2013.01); *F25B 2313/0233* (2013.01)

(58) Field of Classification Search
CPC ..... F25B 13/00; F25B 2313/003; F25B 2313/029
See application file for complete search history.

(56) References Cited

U.S. PATENT DOCUMENTS 5,297,392 A * 3/1994 Takata ..... F25B 41/20 62/160
9,366,452 B2 * 6/2016 Takenaka ..... F24F 11/83
2011/0088421 A1 * 4/2011 Wakamoto ..... F25B 13/00 62/238.7
2011/0185756 A1 8/2011 Yamashita et al.
2011/0192176 A1 8/2011 Kim et al.
2011/0197608 A1 * 8/2011 Yamashita ..... F25B 13/00 62/190
2011/0225998 A1 * 9/2011 Yamashita ..... F25B 13/00 62/126
2011/0232308 A1 * 9/2011 Morimoto ..... F25B 13/00 62/132

(Continued)

FOREIGN PATENT DOCUMENTS

JP 2009210139 9/2009
JP 5236080 7/2013
KR 20180080399 7/2018

OTHER PUBLICATIONS

EP extended European search report, in European Appln. No. 20173851.5, dated Oct. 20, 2020, 4 pages.

(Continued)

*Primary Examiner* — Henry T Crenshaw
(74) *Attorney, Agent, or Firm* — Fish & Richardson P.C.

(57) ABSTRACT

An air conditioning apparatus includes an outdoor device that is configured to circulate refrigerant and that includes a compressor and an outdoor heat exchanger, a plurality of indoor devices configured to circulate water, and a heat exchange device connecting the outdoor device with the indoor device. The heat exchange device includes a heat exchanger configured to exchange heat between the refrigerant and the water, and a switch device configured to control flow of refrigerant between the indoor devices and the heat exchanger.

20 Claims, 6 Drawing Sheets

(56) References Cited

U.S. PATENT DOCUMENTS

| | | | | |
|---|---|---|---|---|
| 2012/0118005 | A1 | 5/2012 | Yamashita et al. | |
| 2012/0174611 | A1* | 7/2012 | Yamashita | F24F 3/065 62/204 |
| 2014/0260387 | A1* | 9/2014 | Takenaka | F24F 11/72 62/205 |
| 2016/0003490 | A1 | 1/2016 | Motomura et al. | |
| 2017/0191706 | A1 | 7/2017 | Ogawa et al. | |

OTHER PUBLICATIONS

PCT International Search Report in International Appln. No. PCT/KR2020/004294, dated Jul. 3, 2020, 3 pages.

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2019-0060842, filed on May 23, 2019, which is hereby incorporated by reference in its entirety.

TECHNICAL FIELD

The present disclosure relates to an air conditioning apparatus.

BACKGROUND

An air conditioning apparatus may maintain air in a space to be an optimal state according to uses or purposes. In some examples, an air conditioning apparatus may include a compressor, a condenser, an expansion device, and an evaporator, and may drive a cooling cycle for compressing, condensing, expanding, and evaporating refrigerant to thereby cool or heat the space.

The air conditioning apparatus may be used in various places.

In some cases, when the air conditioning apparatus performs a cooling operation, an outdoor heat exchanger provided in an outdoor device may operate as a condenser and an indoor heat exchanger provided in an indoor device may operate as an evaporator. In some cases, when the air conditioning apparatus performs a heating operation, the indoor heat exchanger may operate as a condenser, and the outdoor heat exchanger may operate as an evaporator.

In some cases, the type and amount of refrigerant used in the air conditioning apparatus may be limited by environmental regulations. In some cases, to ensure safety from leakage of the refrigerant, it may be required to limit an installation location of a refrigerant line into an indoor space.

In some examples, the air conditioning apparatus may perform a cooling operation or a heating operation by heat-exchanging between the refrigerant and a specific fluid such as water.

An air conditioning apparatus, which performs the cooling operation or the heating operation through the heat exchange between the refrigerant and the water, may prevent air from being included in a pipe (hereinafter, referred to as a "water pipe") through which water flow. In other words, a cycle (hereinafter, referred to as a "water circulation cycle") in which water circulates is provided to be independent from air (or outdoor air).

In some cases, the air conditioning apparatus may include a plurality of heat exchangers to exchange heat between the refrigerant and the water. In addition, the plurality of heat exchangers may operate as an evaporator or a condenser in each refrigerant cycle. Accordingly, cooling and heating may be simultaneously provided from one outdoor device to a plurality of rooms depending on the operating mode of the heat exchanger.

In some examples, the air conditioning apparatus may include two 4-way valves that are used to set the operating mode of the heat exchanger.

In some cases, when the switching operation of the 4-way valve is performed to change the operating mode of the heat exchanger, the pressure of a refrigerant introduced to or discharged from the heat exchanger may rapidly change.

In some cases, the switching operation of the 4-way valve may be difficult since the pressure difference of the refrigerant made is relatively great when the operating mode of the heat exchanger is switched.

In some cases, when the operating mode of the heat exchanger is switched, loud noise may be caused due to the pressure difference of the refrigerant.

In some cases, when the operating mode of the heat exchanger is switched, components may be damaged due to the pressure difference of the refrigerant, thereby degrading the durability.

In some cases, when the switching operation of the 4-way valve is incompletely performed due to the pressure difference of the refrigerant, the heat exchange performance of the heat exchange may be reduced. Accordingly, the reliability of the air conditioning apparatus may be degraded.

In some cases, the operating frequency Hz of the compressor may be reduced or operation of the compressor may be interrupted when minimizing the pressure difference of the refrigerant to smoothly switch the 4-way valve.

In some cases, the interruption of operation of the compressor or the reduction of the operating frequency may weaken cooling or heating in another indoor device which is set to normally maintain the existing cooling or heating state. Accordingly, the performance of the air conditioning apparatus may be reduced and the comfortable sensation of occupants may be reduced.

SUMMARY

The present disclosure describes an air conditioning apparatus capable of solving the above problems.

In particular, the present disclosure describes an air conditioning apparatus capable of performing switching of the operating mode of a heat exchanger while maintaining cooling or heating performance provided to a plurality of indoor spaces.

The present disclosure also describes an air conditioning apparatus capable of providing cooling and heating to a plurality of indoor devices while stably switching the operating mode of a heat exchanger corresponding to the change of the operating mode of an indoor device, which is required depending on an indoor environment.

The present disclosure further describes an air conditioning apparatus capable of maintaining the operating capability of a compressor when the operation of a heat exchanger is switched while minimizing the pressure difference of the refrigerant.

According to one aspect of the subject matter described in this application, an air conditioning apparatus includes: an outdoor device that is configured to circulate refrigerant and that includes a compressor, an outdoor heat exchanger, a high pressure gas pipe, a low pressure gas pipe, and a liquid pipe; a plurality of indoor devices configured to circulate water; and a heat exchange device that connects the outdoor device to the plurality of indoor devices. The heat exchange device includes: a heat exchanger configured to exchange heat between the refrigerant and the water, and a switch device configured to control flow of refrigerant between the outdoor device and the heat exchanger. The switch device includes: a high pressure guide pipe connected to the high pressure gas pipe of the outdoor device, a low pressure guide pipe connected to the low pressure gas pipe of the outdoor device, a refrigerant pipe that is connected to a joining point of the high pressure guide pipe and the low pressure guide pipe and that extends to the heat exchanger, a liquid guide pipe that extends from the heat exchanger to the liquid pipe of the outdoor device, and a pressure equilibrium pipe that is branched from the refrigerant pipe and that is connected to the low pressure guide pipe.

Implementations according to this aspect may include one or more of the following features. For example, the air conditioning apparatus may further include: a high pressure valve installed at the high pressure guide pipe and configured to open and close the high pressure guide pipe; and a low pressure valve installed at the low pressure guide pipe and configured to open and close the low pressure guide pipe.

In some implementations, the air conditioning may further include a flow rate valve installed at the liquid guide pipe and configured to adjust a flow rate of refrigerant in the liquid guide pipe. In some examples, the flow rate valve may include an electric expansion valve.

In some implementations, the air conditioning apparatus may further include a pressure equilibrium valve installed at the pressure equilibrium pipe. In some implementations, the air conditioning apparatus may further include a water pipe that connects the plurality of indoor devices to the heat exchanger and that is configured to circulate water.

In some implementations, the heat exchanger may include a plurality of heat exchangers, and each of the high pressure guide pipe, the low pressure guide pipe, and the liquid guide pipe may split into a plurality of pipes that extend to the plurality of heat exchangers, respectively. In some examples, the switch device may be configured to switch the flow of refrigerant to allow at least one of the plurality of heat exchangers to operate as a condenser or an evaporator.

In some implementations, the heat exchanger may include a first heat exchanger and a second heat exchanger, and the high pressure guide pipe may include: a first high pressure guide pipe that extends from the high pressure gas pipe of the outdoor device and that is connected to the first heat exchanger; and a second high pressure guide pipe that is branched from the first high pressure guide pipe and that is connected to the second heat exchanger.

In some examples, the first heat exchanger and the second heat exchanger may be configured to, based on operating modes thereof, allow one or more of the plurality of indoor devices to perform cooling while one or more of the plurality of indoor devices perform heating. In some examples, the air conditioning apparatus may further include valves that are installed at the first high pressure guide pipe and the second high pressure guide pipe and that are configured to control pressure of the refrigerant.

In some implementations, the low pressure guide pipe may include: a first low pressure guide pipe that extends from the low pressure gas pipe and that is connected to the first high pressure guide pipe; and a second low pressure guide pipe that is branched from the second low pressure guide pipe and that extends to the second high pressure guide pipe. In some examples, the air conditioning apparatus may further include valves that are installed at the first high pressure guide pipe and the second high pressure guide pipe and that are configured to control pressure of the refrigerant.

In some implementations, the liquid guide pipe may include: a first liquid guide pipe that extends from the liquid pipe of the outdoor device to the first heat exchanger; and a second liquid guide pipe that is branched from the first liquid guide pipe and that extends to the second heat exchanger. In some examples, the air conditioning apparatus may further include valves that are installed at the first liquid guide pipe and the second liquid guide pipe and that are configured to control flow rates of the refrigerant.

In some implementations, the air conditioning apparatus may further include: a high pressure valve installed at the high pressure guide pipe and configured to open and close the high pressure guide pipe; a low pressure valve installed at the low pressure guide pipe and configured to open and close the low pressure guide pipe; a flow rate valve installed at the liquid guide pipe and configured to adjust a flow rate of refrigerant in the liquid guide pipe; and a controller configured to control operation of the high pressure valve, the low pressure valve, and the flow rate valve.

In some examples, the heat exchanger may include a plurality of heat exchangers, and the air conditioning apparatus may further include a pressure equilibrium valve installed at the pressure equilibrium pipe. The controller may be configured to, based on at least one of the plurality of heat exchangers being switched to operate in an operation mode, open the pressure equilibrium valve corresponding to the at least one of the plurality of heat exchangers.

According to another aspect, an air conditioning apparatus includes: an indoor device configured to circulate water; an outdoor device that is configured to circulate refrigerant and that includes a high pressure gas pipe, a low pressure gas pipe, and a liquid pipe; a first heat exchanger and a second heat exchanger that connect the outdoor device to the indoor device and that are configured to exchange heat between the refrigerant and the water; a first high pressure guide pipe that extends from the high pressure gas pipe of the outdoor device to a first side of the first heat exchanger; a second high pressure guide pipe that is branched from the high pressure gas pipe and that is connected to a first side of the second heat exchanger; a first low pressure guide pipe that extends from the low pressure gas pipe of the outdoor device and that is connected to the first high pressure guide pipe; a second low pressure guide pipe that is branched from the low pressure gas pipe and that extends to the second high pressure guide pipe; a first liquid guide pipe that extends from the liquid pipe of the outdoor device to a second side of the first heat exchanger; a second liquid guide pipe that is branched from the liquid pipe and that extends to a second side of the second heat exchanger; a first high pressure valve installed at the first high pressure guide pipe and a second high pressure valve installed at the second high pressure guide pipe; a first low pressure valve installed at the first low pressure guide pipe and a second low pressure valve installed at the second low pressure guide pipe; a first flow rate valve installed at the first liquid guide pipe and a second flow rate valve installed at the second liquid guide pipe; and a controller configured to control operation of the first and second high pressure valves, the first and second low pressure valves, and the first and second flow rate valves.

Implementations according to this aspect may include one or more of the following features. For example, the first high pressure guide pipe and the first low pressure guide pipe may be connected to each other at a first joining point, and the second high pressure guide pipe and the second low pressure guide pipe may be connected to each other at a second joining point. The air conditioning apparatus may further include: a first refrigerant pipe that extends from the first joining point to the first side of the first heat exchanger; a second refrigerant pipe that extends from the second joining point to the first side of the second heat exchanger; a first pressure equilibrium pipe that is branched from the first refrigerant pipe and that extends to the first low pressure guide pipe; and a second pressure equilibrium pipe that is branched from the second refrigerant pipe and that extends to the second low pressure guide pipe.

In some implementations, the air conditioning apparatus may further include: a first pressure equilibrium valve installed at the first pressure equilibrium pipe; and a second pressure equilibrium valve installed at the second pressure equilibrium pipe.

In some implementations, the operating mode of the heat exchanger may be switched without weakening the cooling or the heating provided to a plurality of indoor spaces, and the comfortable sensation of occupants may be improved.

In some implementations, when the operating mode of the heat exchanger is switched, the noise caused by the pressure difference of the refrigerant may be minimized because the pressure equilibrium pipe and the valve are provided to control the pressure difference when the operating mode of the heat exchanger is switched.

In some implementations, the efficiency of the heat exchange between the refrigerant and the water may be prevented from being lowered due to the pressure difference of the refrigerant in the heat exchanger. In other words, the heat exchange performance may be maintained and improved.

In some implementations, since the switching of the valve is not tried forcibly in the state that the pressure difference of the refrigerant is present, parts may not be damaged.

In some implementations, since the switching of the operating mode of the heat exchange is performed in the state that the pressure difference of the refrigerant is minimized, the switching of the cooling or heating operation, which is configured to be performed by a plurality of indoor devices, may be stably and safely provided. The reliability of the product may be improved.

In some implementations, it may be unnecessary to stop operating the compressor or reduce the operating frequency of the compressor for the switching of the operation of the heat exchanger, and thus unnecessary power consumption may be reduced, thereby improving the cooling and heating performance of the air conditioning apparatus. Accordingly, the comfortable sensation of an occupant may be maintained and improved.

DETAILED DESCRIPTION

Reference will now be made in detail to the implementations of the present disclosure, examples of which are illustrated in the accompanying drawings.

Figure 1:
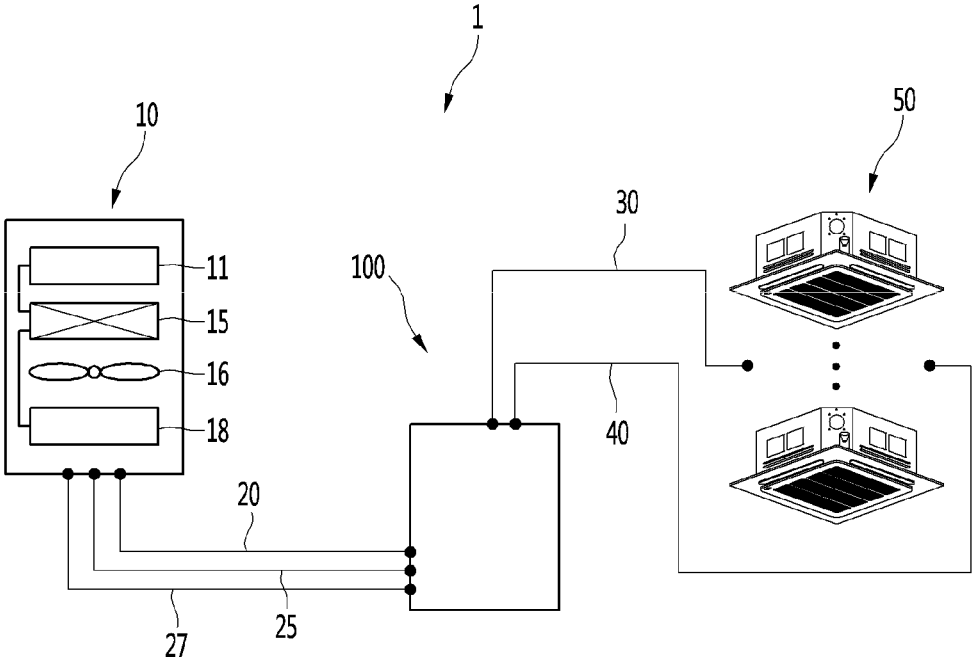
FIG. 1 is a schematic view illustrating an example of an air conditioning apparatus.

FIG. 1 is a schematic view illustrating an example of an air conditioning apparatus.

Referring to FIG. 1, an air conditioning apparatus 1 may include an outdoor device 10, an indoor device 50, and a heat exchange device 100 configured to exchange heat between refrigerant circulating the outdoor device 10 and water circulating the indoor device 50.

In some implementations, the heat exchange device 100 may include heat exchangers 101 and 102 to exchange heat between cooling water and a refrigerant and a switch device R to control the flow of the refrigerant. The switch device R may connect the heat exchangers 101 and 102 with the outdoor device 10 (see FIG. 2).

In some examples, the outdoor device 10 may include an outdoor device to perform both cooling and heating operations.

The switch device R may switch the flow direction of the refrigerant through the operation of a valve provided in the switch device R. In addition, the switch device R may adjust the flow rate of the refrigerant through the operation of the valve.

The outdoor device 10 and the heat exchange device 100 may be fluidly connected with each other through a first fluid. For example, the first fluid may include a refrigerant.

The refrigerant may flow to circulate through a refrigerant passage provided in the heat exchange device 100 and the outdoor device 10.

The outdoor device 10 may include a compressor 11 and an outdoor heat exchanger 15.

In some examples, an outdoor fan 16 may be provided at one side of the outdoor heat exchanger 15.

The outdoor fan 16 may blow external air toward the outdoor heat exchanger 15. As the outdoor fan 16 is driven, heat may be exchanged between the external air and the refrigerant of the outdoor heat exchanger 15.

In addition, the outdoor device 10 may further include a main expansion valve 18. In some examples, the main expansion valve 18 may be an electric expansion valve (EEV) configured to be controlled by a controller comprising an electric circuit.

The air conditioning apparatus 1 may further include three pipes 20, 25, and 27 to connect the outdoor device 10 with the heat exchange device 100.

The three pipes 20, 25, and 27 may include a high pressure gas pipe 20 through which gas-phase refrigerant having high pressure flows, a low pressure gas pipe 25 through which gas-phase refrigerant having low pressure flows, and a liquid pipe 27 through which a liquid refrigerant flows.

For example, the high pressure gas pipe 20 may be connected with a discharge side of the compressor 11. For example, the low pressure gas pipe 25 may be connected with a suction side of the compressor 11. In addition, the liquid pipe 27 may be connected with the outdoor heat exchanger 15.

In other words, the outdoor device 10 and the heat exchange device 100 may have a "three-pipe connection structure." In addition, the refrigerant may circulate the outdoor device 10 and the heat exchange device 100 through the three pipes 20, 25, and 27.

The indoor device 50 and the heat exchange device 100 may be fluidly connected with each other through a second fluid. For example, the second fluid may include water.

The water may flow through a water passage provided in the heat exchange device 100, and the indoor device 50. In other words, the heat exchangers 101 and 102 may be provided such that heat is exchanged between the refrigerant passage and the water passage. For example, the heat exchangers 101 and 102 may include a plate type heat exchanger to exchange heat between the water and the refrigerant.

The indoor device 50 may include a plurality of indoor devices 51, 52, 53, and 54.

The plurality of indoor devices 51, 52, 53, and 54 may include an indoor heat exchanger to exchange heat between indoor air and water and an indoor fan provided at one side of the indoor heat exchanger to provide wind blowing.

In some implementations, the air conditioning apparatus 1 may further include water pipes 30 and 40 to guide water flowing such that the water circulates the indoor device 50 and the heat exchange device 100. The water pipes 30 and 40 may form a circulation cycle W (see FIG. 2) of water.

The water pipes 30 and 40 may include a discharge pipe 30 to connect the heat exchange device 100 with one side of the indoor device 50 and an introduction pipe 40 to connect the heat exchange device 100 with an opposite side of the indoor device 50.

The introduction pipe 40 may be connected with an outlet of the indoor device 50 to guide water, which is output through the indoor device 50, to the heat exchange device 100.

The discharge pipe 30 may be connected with an inlet of the indoor device 50 to guide water, which is discharged from the heat exchange device 100, to the indoor device 50.

In other words, the water may circulate the heat exchange device 100 and the indoor device 50 through the water pipes 30 and 40.

Through the above configuration, the refrigerant circulating between the outdoor device 10 and the heat exchange device 100 and the water circulating between the indoor device 50 and the heat exchange device 100 may exchange heat through the heat exchangers 101 and 102.

In addition, the cooled or heated water through the heat exchange process exchanges heat through an indoor heat exchanger provided in the indoor device 50 such that a cooling or heating process may be performed in an indoor space.

For example, water cooled as heat of the water is discharged to a refrigerant may circulate in the indoor device 50 operating in a cooling mode. In addition, water heated as the water absorbs heat from a refrigerant may circulate in the indoor device 50 operating in the heating mode. Accordingly, indoor air suctioned by the indoor fan may be cooled or heated and then may be discharged to the indoor space.

Figure 2:
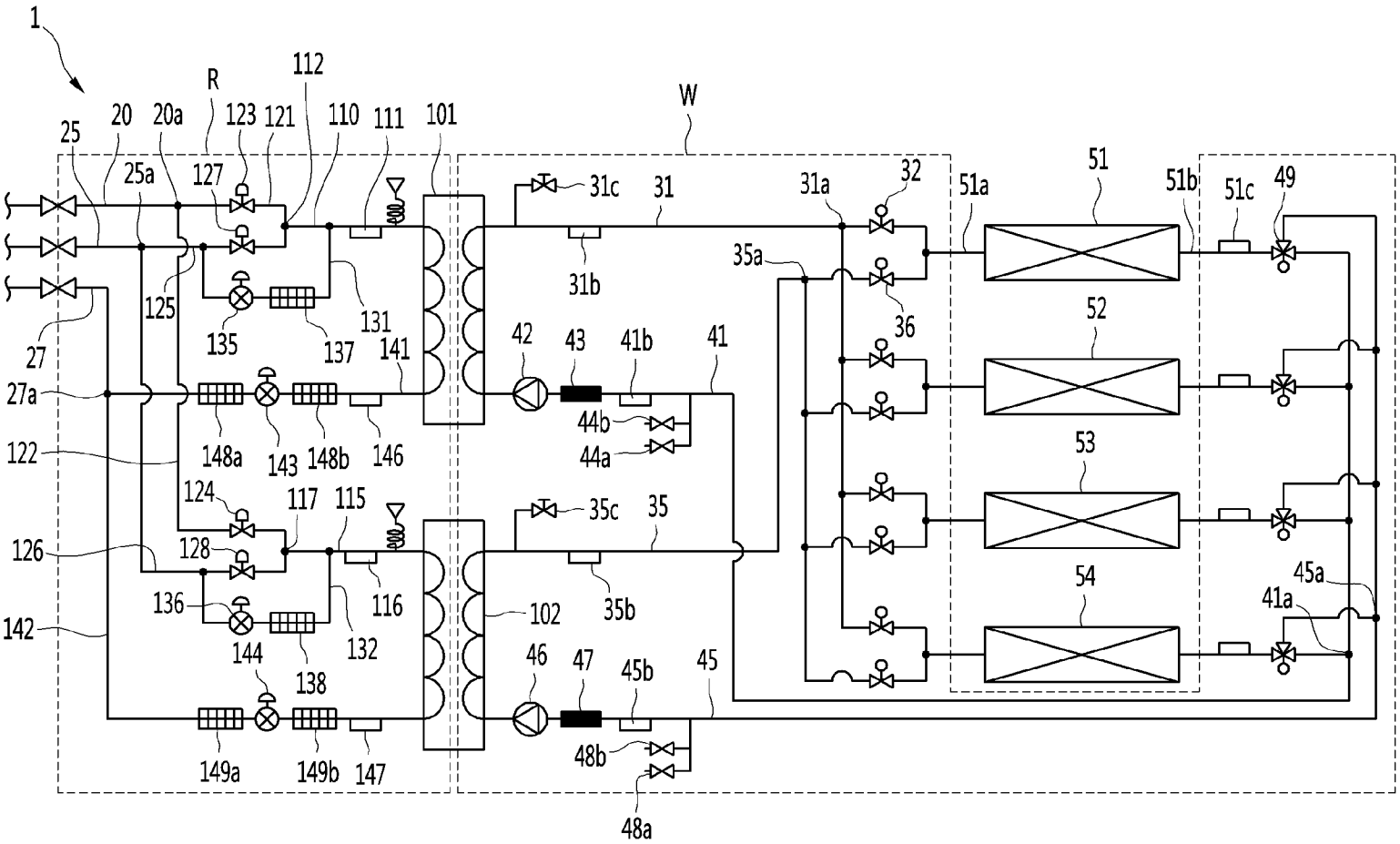
FIG. 2 is a view illustrating an example configuration of an air conditioning apparatus.

FIG. 2 is a view illustrating an example configuration of the air conditioning apparatus.

A water circulation cycle W between the heat exchange device 100 and the indoor device 50 will be described in detail with reference to FIG. 2.

Referring to FIG. 2, the heat exchange device 100 may include the heat exchangers 101 and 102 to exchange heat between the first fluid and the second fluid.

As described above, the first fluid includes a refrigerant and the second fluid includes water.

In addition, the heat exchangers 101 and 102 may be provided in plural such that cooling and heating are simultaneously provided to the indoor device 50.

For example, the heat exchangers 101 and 102 may include a first heat exchanger 101 and a second heat exchanger 102. The number of the heat exchangers 101 and 102 is not limited thereto.

Accordingly, the water may be selectively introduced into the first heat exchanger 101 or the second heat exchanger 102 to exchange heat with the refrigerant depending on an indoor device operating in the cooling or heating mode.

The heat exchangers 101 and 102 may include a plate type heat exchanger. For example, the heat exchangers 101 and 102 may be configured such that a flow passage through which a refrigerant flows and a flow passage through which the water flows.

In some implementations, the heat exchange device 100 may further include a switch device R connecting the heat exchangers 101 and 102 with the outdoor device 10.

The switch device R may control the flow direction and the flow rate of the refrigerant circulating through the first heat exchanger 101 and the second heat exchanger 102. The detailed description of the switch device R will be described in detail.

A plurality of indoor devices 50 may be provided. For example, the indoor device 50 may include a first indoor device 51, a second indoor device 52, a third indoor device 53, and a fourth indoor device 54. The number of the indoor devices 50 is not limited thereto.

As described above, the indoor device 50 and the heat exchange device 100 may be connected with each other through water pipes 30 and 40 through which water flows. In addition, the water pipes 30 and 40 may form a water circulation cycle W of water circulating the indoor device 50 and the heat exchange device 100. In other words, the water may flow the heat exchangers 101 and 102 and the indoor device 50 through the water pipes 30 and 40.

In detail, the water pipes 30 and 40 may include introduction pipes 41 and 45 to guide water such that the water is introduced into the heat exchangers 101 and 102 and discharge pipes 31 and 35 to guide water discharged from the heat exchangers 101 and 102.

The introduction pipes 41 and 45 may guide water output through the indoor device 50 to the heat exchangers 101 and 102. The discharge pipes 31 and 35 may guide water discharged through the heat exchangers 101 and 102 to the indoor device 50.

The introduction pipes 41 and 45 are a first introduction pipe 41 to guide water to the first heat exchanger 101 and a second introduction pipe 45 to guide water to the second heat exchanger 102.

The discharge pipes 31 and 35 may include a first discharge pipe 31 to guide water output through the first heat exchanger 101 to the indoor device 50 and a second discharge pipe 35 to guide water output through the second heat exchanger 102 to the indoor device 50.

In more detail, the first introduction pipe 41 may extend to a water inlet of the first heat exchanger 101. Further, the first discharge pipe 31 may extend to a water outlet of the first heat exchanger 101.

Similarly, the second introduction pipe 45 may extend to the water inlet of second heat exchanger 102. Further, the second discharge pipe 35 may extend to the water outlet of the second heat exchanger 102.

In addition, the discharge pipes 31 and 35 may extend the indoor devices 51, 52, 53, and 54 from the water outlet of the heat exchangers 101 and 102.

Accordingly, the water introduced from the introduction pipes 41 and 45 to the water inlet of the heat exchangers 101 and 102 may exchange heat with the refrigerant, and may be introduced to discharge pipes 31 and 35 through the water outlets of the heat exchangers 101 and 102.

The air conditioning apparatus 1 may further include pumps 42 and 46 installed on the introduction pipes 41 and 45.

The pumps 42 and 46 may provide pressure to direct the water in the introduction pipes 41 and 45 to the heat exchangers 101 and 102. In other words, the pumps 42 and 46 may be installed in the water pipe to set the flow direction of the second fluid.

The pumps 42 and 46 may include a first pump 42 installed in the first introduction pipe 41 and a second pump 46 installed in the second introduction pipe 45.

The pumps 42 and 46 may force the flow of water. For example, when the first pump 42 is driven, water may circulate between the indoor device 50 and the first heat exchanger 101.

In other words, the first pump 42 may provide water circulation through the first introduction pipe 41, the first heat exchanger 101, the first discharge pipe 31, the indoor introduction pipe 51*a*, the indoor devices 51, 52, 53, and 54, and the indoor discharge pipe 51*b*.

The air conditioning apparatus 1 may further include water supply valves 44*a* and 48*a* and relief valves 44*b* and 48*b* installed on pipes branching from the introduction pipes 41 and 45.

The water supply valves 44*a* and 48*a* may provide or restrict water to the introduction pipes 41 and 45 through opening and closing operations.

In addition, the water supply valves 44*a* and 48*a* may include the first water supply valve 44*a* configured to open and close to provide water to the first introduction pipe 41 and the second water supply valve 48*a* configured to open and close to provide water to the second introduction pipe 45.

In some implementations, the relief valves 44*b* and 48*b* may be provided to release pressure in the emergency situation that the internal pressure of the water pipe exceeds the design pressure through the opening or closing operation. The relief valves 44*b* and 48*b* may be named safety valves.

The relief valves 44*b* and 48*b* may include a first relief valve 44*b* installed on the pipe connected with the first introduction pipe 41 and a second relief valve 48*b* installed on the pipe connected with the second introduction pipe 45.

The air conditioning apparatus 1 may further include water pipe strainers 43 and 47 and introduction sensors 41*b* and 45*b* installed on the introduction pipes 41 and 45.

The water pipe strainers 43 and 47 may be provided to filter a waste in the water flowing through the water pipe. For example, the water pipe strainers 43 and 47 may be formed of a metal mesh.

The water pipe strainers 43 and 47 may include a strainer 43 installed on the first introduction pipe 41 and a strainer 47 installed on the second introduction pipe 45.

The water pipe strainers 43 and 47 may be positioned at the inlet side of the pumps 42 and 46.

The introduction sensors 41*b* and 45*b* may detect a state of water flowing through the introduction pipes 41 and 45. For example, the introduction sensors 41*b* and 45*b* may be provided as sensors to detect a temperature and pressure.

The introduction sensors 41*b* and 45*b* may include a first introduction sensor 41*b* installed on the first introduction pipe 41 and a second introduction sensor 45*b* installed on the second introduction pipe 45.

The air conditioning apparatus 1 may further include purge valves 31*c* and 35*c* installed on the discharge pipes 31 and 35.

In detail, the purge valves 31*c* and 35*c* may include a first purge valve 31*c* installed on the first discharge pipe 31 and a second purge valve 35*c* installed on the second discharge pipe 35.

The purge valves 31*c* and 35*c* may discharge the internal air of the water pipes to the outside by the opening and closing operation.

The air conditioning apparatus 1 may further include temperature sensors 31*b* and 35*b* installed on the discharge pipes 31 and 35.

The temperature sensors 31*b* and 35*b* may sense the state of the water subject to heat-exchange to the refrigerant. For example, the temperature sensors 31*b* and 35*b* may include thermistor temperature sensors.

The temperature sensors 31*b* and 35*b* may include a first introduction sensor 31*b* installed on the first introduction pipe 41 and a second introduction sensor 35*b* installed on the second introduction pipe 45.

The discharge pipes 31 and 35 may be split while extending to respective introduction sides of the plurality of indoor devices 51, 52, 53, and 54.

In other words, branch points 31*a* and 35*a* may be formed at one end portions of the discharge pipes 31 and 35 such that the discharge pipes 31 and 35 are split to the indoor devices 51, 52, 53, and 54. The discharge pipes 31 and 35 may be split from the branch points 31*a* and 35*a* and may extend to the indoor introduction pipe 51*a* coupled to the inlet of the indoor devices 51, 52, 53, and 54.

In other words, the water pipe may further include an indoor introduction pipe 51*a* connected with outlets of the indoor devices 51, 52, 53, and 54.

The indoor introduction pipe 51*a* may include a first indoor introduction pipe 51*a* coupled to an inlet of the first indoor device 51, a second indoor introduction pipe coupled to an inlet of the second indoor device 52, a third indoor introduction pipe coupled to the inlet of the third indoor device 53, and a fourth indoor introduction pipe coupled to an inlet of the fourth indoor device 54.

The first discharge pipe 31 may have the first branch point 31*a* at which the first discharge pipe 31 is split into indoor introduction pipes 51*a*. The second discharge pipe 35 may have the second branch point 35*a* at which the second discharge pipe 35 is split into the indoor introduction pipes 51*a*.

In other words, the first discharge pipe 31 is split from the first branch point 31*a* while extending and the second discharge pipe 35 is split from the second branch point 35*a* while extending may be jointed to the indoor introduction pipe 51*a*.

The air conditioning apparatus 1 may further include on/off valves 32 and 36 to adjust an amount of water introduced into the indoor device 50.

The on/off valves 32 and 36 may restrict the flow rate of water introduced into the indoor introduction pipe 51*a* through an opening/closing operation.

In other words, the on/off valves 32 and 36 may include a first on/off valve 32 installed on the first discharge pipe 31 and a second on/off valve 36 installed on the second discharge pipe 35.

In detail, the first on/off valve 32 may be installed on a pipe branching from the first branch point 31*a* and extending to the indoor introduction pipe 51*a*. In other words, the first on/off valve 32 may be installed for each pipe branching from the first branch point 31*a*. Therefore, first on/off valves 32 may be provided in number corresponding to the number of the indoor devices 50.

In detail, the second on/off valve 36 may be installed on a pipe branching from the second branch point 35*a* and extending to the indoor introduction pipe 51*a*. In other words, the second on/off valve 36 may be installed for each pipe branching from the second branch point 35*a*. Therefore, second on/off valves 36 may be provided in number corresponding to the number of the indoor devices 50.

The water pipe may further include indoor discharge pipes 51*b* coupled to the outlets of the indoor devices 51, 52, 53, and 54.

The indoor discharge pipe 51*b* may include a first indoor discharge pipe 51*b* coupled to the outlet of the first indoor device 51, a second indoor discharge pipe coupled to the outlet of the second indoor device 52, a third indoor discharge pipe coupled to an outlet of the third indoor device 53, and a fourth indoor discharge pipe coupled to an outlet of the fourth indoor device 54.

The air conditioning apparatus 1 may further include a detection sensor 51*c* installed on the indoor discharge pipe 51*b*.

The detection sensor 51*c* may detect a state of water flowing through the indoor discharge pipe 51*b*. In one example, the detection sensor 51*c* may include a sensor to detect the temperature and pressure of the water.

The detection sensor 51*c* includes a first detection sensor 51*c* installed in the first indoor discharge pipe 51*b*, a second detection sensor installed in the second indoor discharge pipe, a third detection sensor installed in the third indoor discharge pipe, and a fourth detection sensor installed in the fourth indoor discharge pipe.

The air conditioning apparatus 1 may further include a fluid passage guide valve 49 coupled to the indoor discharge pipe 51*b*.

The fluid passage guide valve 49 may control a flow direction of water passing through the indoor device 50 through an opening and closing operation. In other words, the fluid passage guide valve 49 may be controlled to switch the flow direction of water.

For example, the fluid passage guide valve 49 may include a three-way valve.

In detail, the fluid passage guide valve 49 may include a first fluid passage guide valve installed on the first indoor discharge pipe 51*b*, a second fluid passage guide valve installed on the second indoor discharge pipe, a third fluid passage guide valve installed on the third indoor discharge pipe, and a fourth fluid passage guide valve installed on the fourth indoor discharge pipe.

Pipes split from the introduction pipes 41 and 45 and extending to the indoor devices 51, 52, 53, and 54 may be positioned at a joint point at which the pipes are connected with the indoor discharge pipe 51*b*.

In detail, the fluid passage guide valve 49 may have a first port coupled to the indoor discharge pipe 51*b*, a second port coupled to a pipe split and extending from the first introduction pipe 41, and a third port coupled to a pipe split and extending from the second introduction pipe 45.

Accordingly, water output through the indoor devices 51, 52, 53, and 54 may flow to the first heat exchanger 101 or the second heat exchanger 102 operating in the cooling mode or heating mode, through the opening/closing operation of the fluid passage guide valve 49.

The introduction pipes 41 and 45 may have branch points 41*a* and 45*a* at which the introduction pipes 41 and 45 are split to the indoor devices 51, 52, 53, and 54.

In detail, the first introduction pipe 41 may have first branch points 41*a* at which the first introduction pipe 41 is split to the indoor devices 51, 52, 53, and 54.

In other words, the first introduction pipe 41 may be split from the first branch point 41*a* while extending to the indoor devices 51, 52, 53, and 54. In addition, the first introduction pipe 41 split and extending from the first branch point 41*a* may be coupled to the fluid passage guide valve 49.

In detail, the second introduction pipe 45 may have second branch points 45*a* at which the second introduction pipe 45 is split to the indoor devices 51, 52, 53, and 54.

In other words, the second introduction pipe 45 may be split and extending from the second branch point 45*a* to the indoor devices 51, 52, 53, and 54. In addition, the second introduction pipe 45 split and extending from the second branch point 45*a* may be coupled to the fluid passage guide valve 49.

In some implementations, branch points 41*a* and 45*a* of the introduction pipes 41 and 45 may be referred to as "introduction pipe branch points." The branch points 31*a* and 35*a* of the discharge pipes 31 and 35 are formed may be referred to as "discharge pipe branch points."

In some implementations, the heat exchange device 100 may include a switch device R to adjust the flow direction and the flow rate of the refrigerant introducing and discharging the first heat exchanger 101 and the second heat exchanger 102.

In detail, the switch device R may include refrigerant pipes 110 and 115 coupled to one side of the heat exchangers 101 and 102 and liquid guide pipes 141 and 142 coupled to an opposite side of the heat exchangers 101 and 102.

The refrigerant pipes 110 and 115 may be coupled to refrigerant inlets and outlets formed at one sides of the heat exchangers 101 and 102. In addition, the liquid guide pipes 141 and 142 may be coupled to refrigerant inlets and outlets formed at opposite sides of the heat exchangers 101 and 102.

Accordingly, the refrigerant pipes 110 and 115 and the liquid guide pipes 141 and 142 may be connected with refrigerant fluid passages provided in the heat exchangers 101 and 102 to exchange heat with the water.

The refrigerant pipes 110 and 115 and the liquid guide pipes 141 and 142 may guide the refrigerant such that the refrigerant passes through the heat exchangers 101 and 102.

In detail, the refrigerant pipes 110 and 115 may include a first refrigerant pipe 110 coupled to one side of the first heat exchanger 101 and the second refrigerant pipe 115 coupled to one side of the second heat exchanger 102.

In some examples, the liquid guide pipes 141 and 142 may include a first liquid guide pipe 141 coupled to an opposite side of the first heat exchanger 101 and a second liquid guide pipe 142 coupled to an opposite side of the second heat exchanger 102.

For example, the refrigerant may circulate the first heat exchanger 101 through the first refrigerant pipe 110 and the first liquid guide pipe 141. The refrigerant may circulate the second heat exchanger 102 through the second refrigerant pipe 115 and the second liquid guide pipe 142.

The liquid guide pipes 141 and 142 may be coupled to the liquid pipe 27.

In detail, the liquid pipe 27 may have a liquid pipe branch point 27*a* at which the liquid pipe 27 is split into the first liquid guide pipe 141 and the second liquid guide pipe 142.

In other words, the first liquid guide pipe 141 may extend from the liquid pipe branch point 27*a* to the first heat exchanger 101, and the second liquid guide pipe 142 may extend from the liquid pipe branch point 27*a* to the second heat exchanger 102.

The air conditioning apparatus 1 may further include gas phase refrigerant sensors 111 and 116 installed in the refrigerant pipes 110 and 115 and liquid refrigerant sensors 146 and 147 installed in the liquid guide pipes 141 and 142.

The gas phase refrigerant sensors 111 and 116 and the liquid refrigerant sensors 146 and 147 may be referred to as "refrigerant sensors."

The refrigerant sensor may detect a state of the refrigerant flowing through the refrigerant pipes 110 and 115 and the liquid guide pipes 141 and 142. For example, the refrigerant sensor may sense the temperature and the pressure of the refrigerant.

The gas phase refrigerant sensors 111 and 116 may include a first gas phase refrigerant sensor 111 installed in the first refrigerant pipe 110 and a second gas phase refrigerant sensor 116 installed in the second refrigerant pipe 115.

The liquid refrigerant sensors 146 and 147 may include a first liquid refrigerant sensor 146 installed in the first liquid guide pipe 141 and a second liquid refrigerant sensor 147 installed in the second liquid guide pipe 142.

In addition, the air conditioning apparatus 1 may further include flow rate valves 143 and 144 installed on the liquid guide pipes 141 and 142 and strainers 148*a*, 148*b*, 149*a*, and 149*b* installed on opposite sides of the flow rate valves 143 and 144, respectively.

The flow rate valves 143 and 144 may adjust the flow rate of the refrigerant by adjusting the opening degree.

The flow rate valves 143 and 144 may include an electric expansion valve (EEV). The flow rate valves 143 and 144 may adjust the pressure of the passing refrigerant by controlling the opening degree. The electronic expansion valve may be configured to open and closed by a controller comprising an electric circuit.

The flow rate valves 143 and 144 may include a first flow rate valve 143 installed on the first liquid guide pipe 141 and a second flow rate valve 144 installed on the second liquid guide pipe 142.

The strainers 148*a*, 148*b*, 149*a*, and 149*b* may be provided to filter out wastes of the refrigerant flowing through the liquid guide pipes 141 and 142. For example, the strainers 148*a*, 148*b*, 149*a*, and 149*b* may include a mesh net.

The strainers 148*a*, 148*b*, 149*a*, and 149*b* may include first strainers 148*a* and 148*b* installed on the first liquid guide pipe 141 and second strainers 149*a* and 149*b* installed on the second liquid guide pipe 142.

In addition, the first strainers 148*a* and 148*b* may include a strainer 148*a* installed at one side of the first flow rate valve 143 and a strainer 148*b* installed at an opposite side of the first flow rate valve 143. Accordingly, even if the flow direction of the refrigerant is switched, the wastes may be filtered out.

In addition, the second strainers 149*a* and 149*a* may include a strainer 149*a* installed at one side of the second flow rate valve 144 and a strainer 149*b* installed at an opposite side of the second flow rate valve 144.

The refrigerant pipes 110 and 115 may be connected with the high pressure gas pipe 20 and the low pressure gas pipe 25. The liquid guide pipes 141 and 142 may be coupled to the liquid pipe 27.

In detail, the refrigerant pipes 110 and 115 may have refrigerant branch points 112 and 117 at one end portions thereof. The high pressure gas pipe 20 and the low pressure gas pipe 25 may be connected with the refrigerant branch points 112 and 117 such that the high pressure gas pipe 20 and the low pressure gas pipe 25 are jointed to each other.

In some examples, the refrigerant branch point 112 may be a first joining point at which the first high pressure guide pipe 121 and the first low pressure guide pipe 125 are connected to each other. The refrigerant branch point 117 may be a second joining point at which the second high pressure guide pipe 122 and the second low pressure guide pipe 126 are connected to each other.

In other words, the refrigerant branch points 112 and 117 may be formed at one end portions of the refrigerant pipes 110 and 115, and refrigerant inlets and outlets of the heat exchangers 101 and 102 may be coupled to opposite end portions of the refrigerant pipes 110 and 115.

The switch device R may further include high pressure guide pipes 121 and 122 extending from the high pressure gas pipe 20 to the refrigerant pipes 110 and 115.

In other words, the high pressure guide pipes 121 and 122 may connect the high pressure gas pipe 20 with the refrigerant pipes 110 and 115.

The high pressure guide pipes 121 and 122 may branch from the high pressure branch point 20*a* of the high pressure gas pipe 20 while extending to the refrigerant pipes 110 and 115.

In detail, the high pressure guide pipes 121 and 122 may include the first high pressure guide pipe 121 extending from the high pressure branch point 20*a* to the first refrigerant pipe 110 and the second high pressure guide pipe 122 extending from the high pressure branch point 20*a* to the second refrigerant pipe 115.

The first high pressure guide pipe 121 may be connected with the first refrigerant branch point 112, and the second high pressure guide pipe 122 may be connected with the second refrigerant branch point 117.

In other words, the first high pressure guide pipe 121 may extend from the high pressure branch point 20*a* to the first refrigerant branch point 112, and the second high pressure guide pipe 122 may extend from the high pressure branch point 20*a* to the second refrigerant branch point 117.

The air conditioning apparatus 1 may further include the high pressure valves 123 and 124 installed on the high pressure guide pipes 121 and 122.

The high pressure valves 123 and 124 may restrict the flow of the refrigerant into the high pressure guide pipes 121 and 122 through the opening and closing operations.

The high pressure valves 123 and 124 may include the first high pressure valve 123 installed on the first high pressure guide pipe 121 and a second high pressure valve 124 installed on the second high pressure guide pipe 122.

The first high pressure valve 123 may be installed between the high pressure branch point 20*a* and the first refrigerant branch point 112.

The second high pressure valve 124 may be installed between the high pressure branch point 20*a* and the second refrigerant branch point 117.

The first high pressure valve 123 may control the flow of the refrigerant between the high pressure gas pipe 20 and the first refrigerant pipe 110. The second high pressure valve 124 may control the flow of the refrigerant between the high pressure gas pipe 20 and the second refrigerant pipe 115.

The switch device R may further include low pressure guide pipes 125 and 126 extending from the low pressure gas pipe 25 to the refrigerant pipes 110 and 115.

In other words, the low pressure guide pipes 125 and 126 may connect the low pressure gas pipe 25 with the refrigerant pipes 110 and 115.

The low pressure guide pipes 125 and 126 may branch from the low pressure branch point 25*a* of the low pressure gas pipe 25 and extend to the refrigerant pipes 110 and 115.

In detail, the low pressure guide pipes 125 and 126 may include the first low pressure guide pipe 125 extending from the low pressure branch point 25*a* to the first refrigerant pipe 110 and the second low pressure guide pipe 126 extending from the low pressure branch point 25*a* to the second refrigerant pipe 115.

The first low pressure guide pipe 125 may be connected with the first refrigerant branch point 112, and the second low pressure guide pipe 126 may be connected with the second refrigerant branch point 117.

In other words, the first low pressure guide pipe 125 may extend from the low pressure branch point 25*a* to the first refrigerant branch point 112, and the second low pressure guide pipe 126 may extend from the low pressure branch point 25*a* to the second refrigerant branch point 117. Accordingly, the high pressure guide pipes 121 and 122 and the low pressure guide pipes 125 and 126 may be joined to each other at the refrigerant branch points 112 and 117.

The air conditioning apparatus 1 may further include the low pressure valves 127 and 128 installed on the low pressure guide pipes 125 and 126.

The low pressure valves 127 and 128 may restrict the flow of the refrigerant into the low pressure guide pipes 125 and 126 through the opening and closing operations.

The low pressure valves 127 and 128 may include the first low pressure valve 127 installed on the first low pressure guide pipe 125 and a second low pressure valve 128 installed on the second low pressure guide pipe 126.

The first low pressure valve 127 may be installed between the first refrigerant branch point 112 and the point connected with the first pressure equilibrium pipe 131 to be described later.

The second low pressure valve 128 may be installed between the second refrigerant branch point 117 and the point connected with the second pressure equilibrium pipe 132 to be described later.

The switch device R may further include pressure equilibrium pipes 131 and 132 branching from the refrigerant pipe 110 while extending to the low pressure guide pipes 125 and 126.

The pressure equilibrium pipes 131 and 132 may include the first pressure equilibrium pipe 131 branching from one point of the first refrigerant pipe 110 while extending to the first low pressure guide pipe 125 and the second pressure equilibrium pipe 132 branching from one point of the second refrigerant pipe 115 while extending to the second low pressure guide pipe 126.

Points, at which the pressure equilibrium pipes 131 and 132 and the low pressure guide pipes 125 and 126 are connected with each other, may be positioned between the low pressure branch point 25*a* and the low pressure valves 127 and 128.

In other words, the first pressure equilibrium pipe 131 may branch from the first refrigerant pipe 110 while extending to the first low pressure guide pipe 125 which is positioned between the low pressure branch point 25*a* and the first low pressure valve 127.

Similarly, the second pressure equilibrium pipe 132 may branch from the second refrigerant pipe 115 while extending to the second low pressure guide pipe 126 which is positioned between the low pressure branch point 25*a* and the second low pressure valve 128.

The air conditioning apparatus 1 may further include pressure equilibrium valves 135 and 136 and pressure equilibrium strainers 137 and 138 installed on the pressure equilibrium pipes 131 and 132.

The pressure equilibrium valves 135 and 136 may bypass the refrigerants of the refrigerant pipes 110 and 115 to the low pressure guide pipes 125 and 126 by controlling the opening degree.

The pressure equilibrium valves 135 and 136 may include EEVs.

The pressure equilibrium valves 135 and 136 may include the first pressure equilibrium valve 135 installed on the first pressure equilibrium pipe 131 and the second pressure equilibrium valve 136 installed on the second pressure equilibrium pipe 132.

The pressure equilibrium strainers 137 and 138 may include the first pressure equilibrium strainer 137 installed on the first pressure equilibrium pipe 131 and the second pressure equilibrium strainer 138 installed on the second pressure equilibrium pipe 132.

The pressure equilibrium strainers 137 and 138 may be positioned between the pressure equilibrium valves 135 and 136 and the refrigerant pipes 110 and 115. Accordingly, the waste may be filtered out of the refrigerant flowing from the refrigerant pipes 110 and 115 to the pressure equilibrium valves 135 and 136 may be filtered or the foreign matters may be prevented.

In some implementations, the pressure equilibrium pipes 131 and 132 and the pressure equilibrium valves 135 and 136 may be named "pressure equilibrium circuits."

The pressure equilibrium circuit may operate to reduce a pressure difference between the high pressure refrigerant and the low pressure refrigerant of the refrigerant pipes 110 and 115 when the operation modes of the heat exchangers 101 and 102 are switched.

In this case, the operation mode of the heat exchangers 101 and 102 may include a condenser mode to operate as a condenser and an evaporator mode to operate as an evaporator.

For example, when the heat exchangers 101 and 102 switch the operation mode from the condenser to the evaporator, the high pressure valves 123 and 124 may be closed and the low pressure valves 127 and 128 may be open. However, such a sudden valve change may cause a problem of generating noise and deteriorating durability due to a large pressure difference between the high pressure refrigerant and the low pressure refrigerant.

In some implementations, the air conditioning apparatus 1 may open the pressure equilibrium valves 135 and 136 for a predetermine time before the high pressure valves 123 and 124 are closed. Accordingly, the refrigerant flowing through the first refrigerant pipe 110 may be introduced into the pressure equilibrium pipes 131 and 132.

The opening degree of the pressure equilibrium valves 135 and 136 may be slowly performed over time. Accordingly, even the opening degrees of the high pressure valves 123 and 124 and the low pressure valves 127 may be performed.

The pressure of the refrigerant pipes 110 and 115 may be lowered due to the refrigerant introduced into the pressure equilibrium pipes 131 and 132.

Therefore, as the pressure equilibrium valves 135 and 136 are open, the pressure difference between the low pressure guide pipes 125 and 126 and the refrigerant pipes 110 and 115 may be reduced to be in a predetermined range and form pressure equilibrium.

In addition, the pressure equilibrium valves 135 and 136 may be closed again. Accordingly, the low pressure refrigerant output through the heat exchangers 101 and 102 may flow to the low pressure guide pipes 125 and 126 without the large pressure difference.

Therefore, since the operations of the heat exchangers 101 and 102 are stably switched to operations as evaporators, the problems of noise and durability, which are caused by the above-described pressure difference, may be solved.

In some implementations, the air conditioning apparatus 1 may further include a controller.

The controller may control the operations of the high pressure valves 123 and 124, the low pressure valves 127 and 128, the pressure equilibrium valves 135 and 136, and the flow rate valves 143 and 144.

Figure 3:
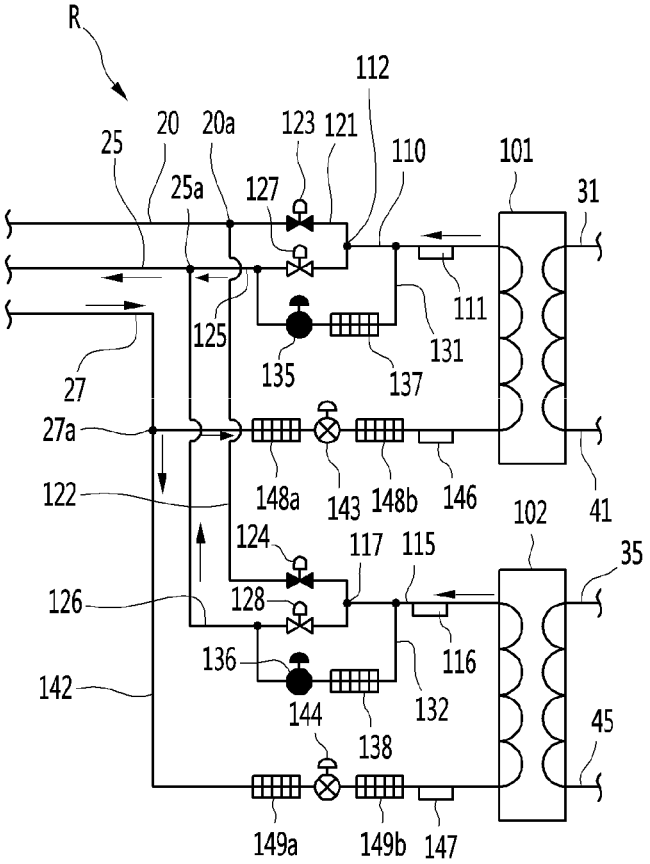
FIG. 3 is a view illustrating an example flow of refrigerant when two example heat exchangers that operate as evaporators.
Figure 4:
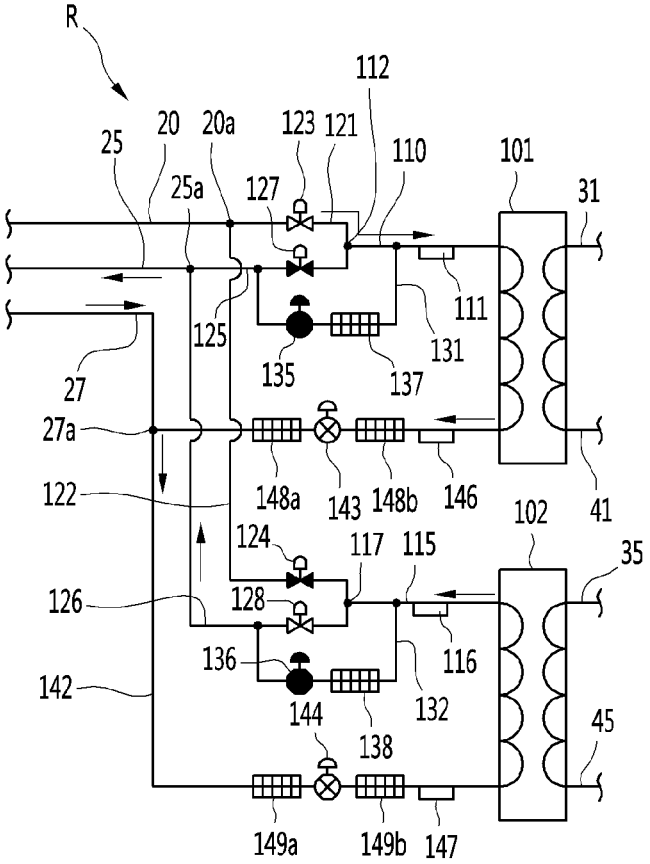
FIG. 4 is a view illustrating an example flow of refrigerant when any one of the two heat exchangers of FIG. 3 is switched to operate as the condenser.

FIG. 3 is a view illustrating an example flow of refrigerant when two example heat exchangers operate as evaporators, and FIG. 4 is a view illustrating an example flow of refrigerant when any one of the two heat exchangers of FIG. 3 is switched to operate at a condenser.

Referring to FIG. 3, the first heat exchanger 101 and the second heat exchanger 102 may operate as evaporators.

In this case, the indoor devices 51, 52, 53, and 54, in which water cooled through the first heat exchanger 101 and the second heat exchanger 102 circulate, may operate in a cooling mode.

The condensed refrigerant output through the outdoor heat exchanger 15 of the outdoor device 10 may be introduced into the switch device R through the liquid pipe 27. The condensed refrigerant is divided at the liquid pipe branch point 27*a* to flow the first liquid guide pipe 141 and the second liquid guide pipe 142.

The condensed refrigerant introduced into the first liquid guide pipe 141 may be expanded while passing through the first flow rate valve 143. The expanded refrigerant may be evaporated by absorbing heat of water while passing through the first heat exchanger 101.

Similarly, the condensed refrigerant introduced into the second liquid guide pipe 142 may be expanded while passing through the second flow rate valve 144. The expanded refrigerant may be evaporated by absorbing heat of water while passing through the second heat exchanger 102.

The evaporated refrigerant discharged from the first heat exchanger 101 may be introduced into the first low pressure guide pipe 125 through the first refrigerant pipe 110 to flow into the low pressure gas pipe 25. In this case, the first low pressure valve 127 is open and the first high pressure valve 123 is closed.

Similarly, the evaporated refrigerant discharged from the second heat exchanger 102 may be introduced into the second low pressure guide pipe 126 through the second refrigerant pipe 115 to flow into the low pressure gas pipe 25. In this case, the second low pressure valve 128 is open and the second high pressure valve 124 is closed.

The pressure equilibrium valves 135 and 136 may be maintained in a closed state in the operations of the heat exchangers 101 and 102 described above.

Thereafter, to switch the mode of at least one of the first to fourth indoor devices 51, 52, 53, and 54 to the heating mode, any one of the first heat exchanger 101 and the second heat exchanger 102 may be switched to a condenser and operate.

Hereinafter, the case that the first heat exchanger 101 is switched to the condenser will be described with reference to FIG. 4.

The first high pressure valve 123 may be open and the first low pressure valve 127 may be closed to switch the operating mode of the first heat exchanger 101. In addition, the first flow rate valve 143 may be fully open.

The compressed refrigerant discharged from the compressor 11 and introduced into the high pressure gas pipe 20 may be introduced into the first refrigerant pipe 110 through the first high pressure guide pipe 121.

The compressed refrigerant introduced into the first refrigerant pipe 110 may heat water while passing through the first heat exchanger 101. Hereinafter, the water absorbing the heat of the refrigerant may circulate the indoor device 50 that requires a heating operation.

The condensed refrigerant exchanging heat with water in the first heat exchanger 101 flows to the liquid pipe branch point 27*a* through the first liquid guide pipe 141 since the first flow rate valve 143 is fully open. In addition, the condensed refrigerant may be introduced into the second liquid guide pipe 142 through the liquid pipe branch point 27*a* and be combined with the condensed refrigerant introduced from the existing liquid pipe 27.

The combined condensed refrigerant may be expanded while passing through the second flow rate valve 144. In addition, the expanded refrigerant may be evaporated while passing through the second heat exchanger 102 as described above and may flow to the low pressure gas pipe 25 through the second low pressure guide pipe 126.

Accordingly, when the operating mode of the first heat exchanger 101 is switched in the state that the first heat exchanger 101 and the second heat exchanger 102 operate as evaporators, the first heat exchanger 101 may be stably operated without being reduced in the operating frequency thereof or stopped.

Figure 5:
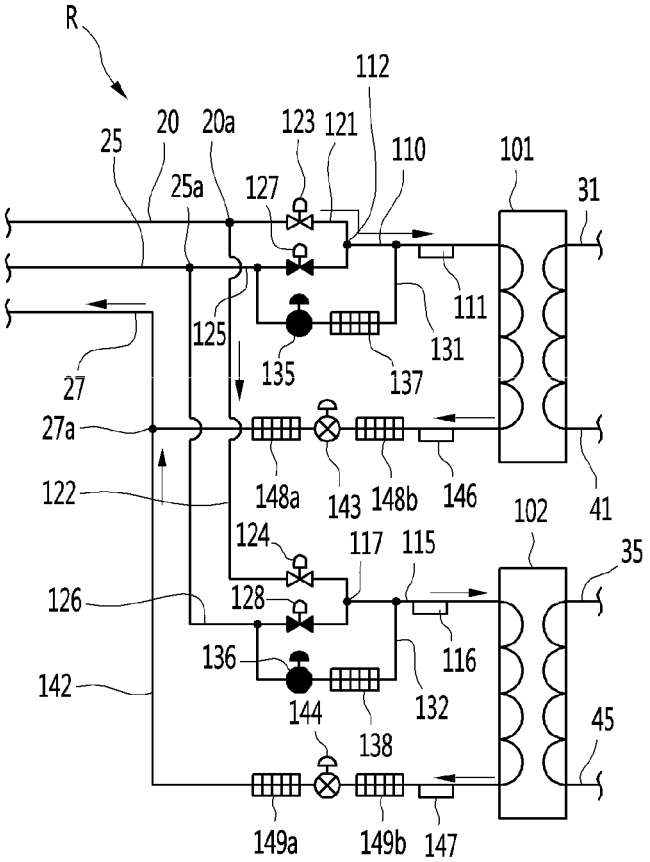
FIG. 5 is a view illustrating an example flow of refrigerant when two examples heat exchangers operate as condensers.
Figure 6:
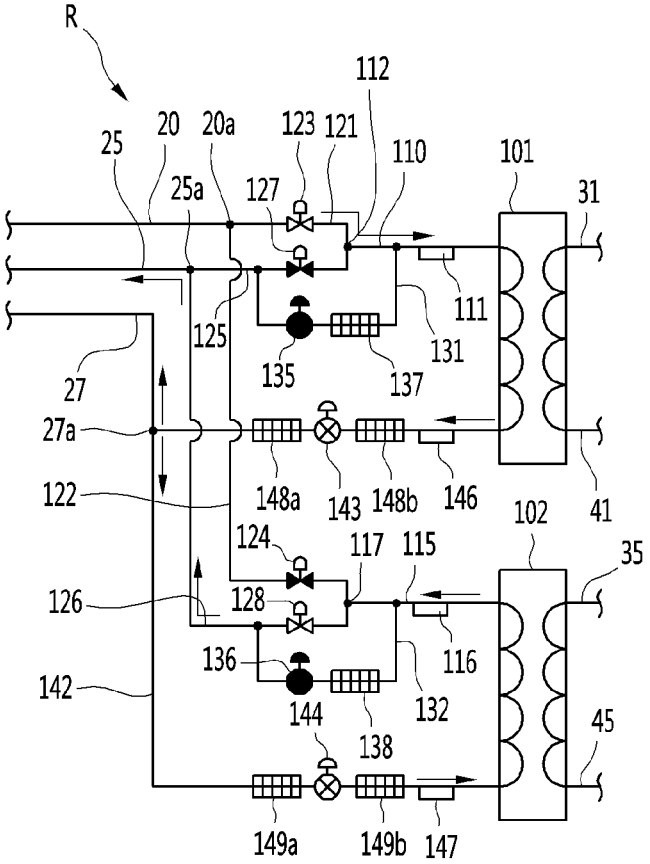
FIG. 6 is a view illustrating an example flow of refrigerant when any one of the two heat exchangers of FIG. 5 is switched to operate as an evaporator.

FIG. 5 is a view illustrating an example flow of refrigerant when two example heat exchangers operate as condensers, and FIG. 6 is a view illustrating an example flow of refrigerant when any one of the two heat exchangers of FIG. 5 is switched to operate as an evaporator.

Referring to FIG. 5, the first heat exchanger 101 and the second heat exchanger 102 may operate as condensers.

For example, the indoor devices 51, 52, 53, and 54, in which water cooled through the first heat exchanger 101 and the second heat exchanger 102 circulate, may operate in a heating mode.

The compressed refrigerant discharged from the compressor 11 of the outdoor device 10 may be introduced into the switch device R through the high pressure gas pipe 20. In addition, the compressed refrigerant may be divided at the high pressure branch point 20*a* and introduced into the first high pressure guide pipe 121 and the second high pressure guide pipe 122.

In this case, the first high pressure valve 123 and the second high pressure valve 124 may be opened. The first low pressure valve 127 and the second low pressure valve 128 may be closed.

The compressed refrigerant introduced into the first high pressure guide pipe 121 may be introduced the first heat exchanger 101 through the first refrigerant pipe 110. In addition, the compressed refrigerant may be condensed by exchanging heat with water in the first heat exchanger 101.

The condensed refrigerant output through the first heat exchanger 101 may be introduced into the liquid pipe 27 through the first liquid guide pipe 141. In addition, the first flow rate valve 143 may be fully open.

The compressed refrigerant introduced into the second high pressure guide pipe 122 may be introduced to the second heat exchanger 102 through the second refrigerant pipe 115. In addition, the compressed refrigerant may be condensed by exchanging heat with water in the second heat exchanger 102.

The condensed refrigerant output through the second heat exchanger 102 may be introduced into the liquid pipe 27 through the second liquid guide pipe 142. In this case, the second flow rate valve 144 may be fully open.

In other words, the condensed refrigerants output through the second heat exchanger 102 and the first heat exchanger 101 are combined at the liquid pipe branch point 27*a* to flow to the main expansion valve 18 through the liquid pipe 27.

The pressure equilibrium valves 135 and 136 may be maintained in a closed state in the operations of the heat exchangers 101 and 102 described above.

Thereafter, to switch the mode of at least one of the first to fourth indoor devices 51, 52, 53, and 54 to the cooling mode, any one of the first heat exchanger 101 and the second heat exchanger 102 may be switched to an evaporator and operate.

Hereinafter, the case that the second heat exchanger 102 is switched to the evaporator will be described with reference to FIG. 6.

As described above, the second pressure equilibrium valve 136 may operate to be open to minimize noise in the switching of the second heat exchanger 102.

Accordingly, the refrigerant flowing through the second high pressure guide pipe 122 to the second refrigerant pipe 115 gradually flows into the second pressure equilibrium pipe 132 as the second pressure equilibrium valve 136 starts to open.

In addition, the pressure of the second refrigerant pipe 115 may be lowered by the refrigerant introduced into the second pressure equilibrium pipe 132.

Thereafter, the second pressure equilibrium valve 136 and the second high pressure valve 124 may be closed, and the second low pressure valve 128 may be opened. In this case, the pressure difference between the second low pressure guide pipe 126 and the second refrigerant pipe 115 may be reduced to be within a specific range through the operation of the second pressure equilibrium valve 136 to form pressure equilibrium.

The condensed refrigerant output through the first heat exchanger 101 may flow into the liquid pipe branch point 27*a* through the first liquid guide pipe 141. The condensed refrigerant is divided at the liquid pipe branch point 27*a* to partially pass to the main expansion valve 18, and the remaining part passes through the second flow rate valve 144 through the second liquid guide pipe 142.

In this case, the second flow rate valve 144 may operate as an expansion valve for expanding the refrigerant by controlling the opening degree.

The expanded refrigerant output through the second flow rate valve 144 may be evaporated by exchanging heat with water while passing through the second heat exchanger 102. The evaporated refrigerant output through the second heat exchanger 102 may flow into the second low pressure guide pipe 126 through the second refrigerant pipe 115.

The evaporated refrigerant may be introduced into the low pressure gas pipe 25 and be recovered to the compressor 11 of the outdoor device 10.

When the second heat exchanger 102 may be switched described above, noise may be minimized due to the pressure difference of the refrigerant.

In addition, the second heat exchanger 102 may be stably switched from the condenser to the evaporator to operate without the influence on the operation of the compressor 11.

What is claimed is:

1. An air conditioning apparatus comprising:

an outdoor device configured to circulate refrigerant, the outdoor device comprising a compressor, an outdoor heat exchanger, an expansion valve, a high pressure gas pipe, a low pressure gas pipe, and a liquid pipe;

a plurality of indoor devices configured to circulate water; and a heat exchange device that connects the outdoor device to the plurality of indoor devices, the heat exchange device comprising:

a heat exchanger configured to exchange heat between the refrigerant and the water, and a switch device configured to control flow of refrigerant between the outdoor device and the heat exchanger, and wherein the switch device comprises:

a high pressure guide pipe connected to the high pressure gas pipe of the outdoor device, a low pressure guide pipe connected to the low pressure gas pipe of the outdoor device, a refrigerant pipe that is connected to a joining point of the high pressure guide pipe and the low pressure guide pipe and that extends to the heat exchanger, a liquid guide pipe that extends from the heat exchanger to the liquid pipe of the outdoor device, and a pressure equilibrium pipe that is branched from the refrigerant pipe and that is connected to the low pressure guide pipe.

2. The air conditioning apparatus of claim 1, further comprising:

a high pressure valve installed at the high pressure guide pipe and configured to open and close the high pressure guide pipe; and a low pressure valve installed at the low pressure guide pipe and configured to open and close the low pressure guide pipe.

3. The air conditioning apparatus of claim 1, further comprising:

a flow rate valve installed at the liquid guide pipe and configured to adjust a flow rate of refrigerant in the liquid guide pipe.

4. The air conditioning apparatus of claim 3, wherein the flow rate valve comprises an electric expansion valve.

5. The air conditioning apparatus of claim 1, further comprising:

a pressure equilibrium valve installed at the pressure equilibrium pipe.

6. The air conditioning apparatus of claim 1, further comprising:

a water pipe that connects the plurality of indoor devices to the heat exchanger and that is configured to circulate water.

7. The air conditioning apparatus of claim 1, wherein the heat exchanger comprises a plurality of heat exchangers, and wherein each of the high pressure guide pipe, the low pressure guide pipe, and the liquid guide pipe splits into a plurality of pipes that extend to the plurality of heat exchangers, respectively.

8. The air conditioning apparatus of claim 7, wherein the switch device is configured to switch the flow of refrigerant to allow at least one of the plurality of heat exchangers to operate as a condenser or an evaporator.

9. The air conditioning apparatus of claim 1, wherein the heat exchanger comprises a first heat exchanger and a second heat exchanger, and wherein the high pressure guide pipe comprises:

a first high pressure guide pipe that extends from the high pressure gas pipe of the outdoor device and that is connected to the first heat exchanger; and a second high pressure guide pipe that is branched from the first high pressure guide pipe and that is connected to the second heat exchanger.

10. The air conditioning apparatus of claim 9, wherein the first heat exchanger and the second heat exchanger are configured to, based on operating modes thereof, allow one or more of the plurality of indoor devices to perform cooling while one or more of the plurality of indoor devices perform heating.

11. The air conditioning apparatus of claim 9, further comprising valves that are installed at the first high pressure guide pipe and the second high pressure guide pipe, the valves being configured to control pressure of the refrigerant.

12. The air conditioning apparatus of claim 9, wherein the low pressure guide pipe comprises:

a first low pressure guide pipe that extends from the low pressure gas pipe and that is connected to the first high pressure guide pipe; and a second low pressure guide pipe that is branched from the second low pressure guide pipe and that extends to the second high pressure guide pipe.

13. The air conditioning apparatus of claim 12, further comprising valves that are installed at the first high pressure guide pipe and the second high pressure guide pipe, the valves being configured to control pressure of the refrigerant.

14. The air conditioning apparatus of claim 9, wherein the liquid guide pipe comprises:

a first liquid guide pipe that extends from the liquid pipe of the outdoor device to the first heat exchanger; and a second liquid guide pipe that is branched from the first liquid guide pipe and that extends to the second heat exchanger.

15. The air conditioning apparatus of claim 14, further comprising valves that are installed at the first liquid guide pipe and the second liquid guide pipe, the valves being configured to control flow rates of the refrigerant.

16. The air conditioning apparatus of claim 1, further comprising:

a high pressure valve installed at the high pressure guide pipe and configured to open and close the high pressure guide pipe;

a low pressure valve installed at the low pressure guide pipe and configured to open and close the low pressure guide pipe;

a flow rate valve installed at the liquid guide pipe and configured to adjust a flow rate of refrigerant in the liquid guide pipe; and a controller configured to control operation of the high pressure valve, the low pressure valve, and the flow rate valve.

17. The air conditioning apparatus of claim 16, wherein the heat exchanger comprises a plurality of heat exchangers, wherein the air conditioning apparatus further comprises a pressure equilibrium valve installed at the pressure equilibrium pipe, and wherein the controller is configured to, based on at least one of the plurality of heat exchangers being switched to operate in an operation mode, open the pressure equilibrium valve corresponding to the at least one of the plurality of heat exchangers.

18. An air conditioning apparatus comprising:

an indoor device configured to circulate water;

an outdoor device configured to circulate refrigerant, the outdoor device comprising a compressor, an outdoor heat exchanger, an expansion valve, a high pressure gas pipe, a low pressure gas pipe, and a liquid pipe;

a first heat exchanger and a second heat exchanger that connect the outdoor device to the indoor device and that are configured to exchange heat between the refrigerant and the water;

a first high pressure guide pipe that extends from the high pressure gas pipe of the outdoor device to a first side of the first heat exchanger;

a second high pressure guide pipe that is branched from the high pressure gas pipe and that is connected to a first side of the second heat exchanger;

a first low pressure guide pipe that extends from the low pressure gas pipe of the outdoor device and that is connected to the first high pressure guide pipe;

a second low pressure guide pipe that is branched from the low pressure gas pipe and that extends to the second high pressure guide pipe;

a first liquid guide pipe that extends from the liquid pipe of the outdoor device to a second side of the first heat exchanger;

a second liquid guide pipe that is branched from the liquid pipe and that extends to a second side of the second heat exchanger;

a first high pressure valve installed at the first high pressure guide pipe and a second high pressure valve installed at the second high pressure guide pipe;

a first low pressure valve installed at the first low pressure guide pipe and a second low pressure valve installed at the second low pressure guide pipe;

a first flow rate valve installed at the first liquid guide pipe and a second flow rate valve installed at the second liquid guide pipe; and a controller configured to control operation of the first and second high pressure valves, the first and second low pressure valves, and the first and second flow rate valves.

19. The air conditioning apparatus of claim 18, wherein the first high pressure guide pipe and the first low pressure guide pipe are connected to each other at a first joining point, wherein the second high pressure guide pipe and the second low pressure guide pipe are connected to each other at a second joining point, and wherein the air conditioning apparatus further comprises:

a first refrigerant pipe that extends from the first joining point to the first side of the first heat exchanger;

a second refrigerant pipe that extends from the second joining point to the first side of the second heat exchanger;

a first pressure equilibrium pipe that is branched from the first refrigerant pipe and that extends to the first low pressure guide pipe; and a second pressure equilibrium pipe that is branched from the second refrigerant pipe and that extends to the second low pressure guide pipe.

20. The air conditioning apparatus of claim 19, further comprising:

a first pressure equilibrium valve installed at the first pressure equilibrium pipe; and a second pressure equilibrium valve installed at the second pressure equilibrium pipe.

* * * * *